US005380642A

United States Patent [19]

Roberts et al.

[11] Patent Number: 5,380,642

[45] Date of Patent: Jan. 10, 1995

[54] PROCESS FOR PREPARING A THIN TABULAR GRAIN SILVER HALIDE EMULSION

[75] Inventors: Michael R. Roberts, Rochester; Wai K. Lam, Webster; Wayne A. Bowman, Walworth; John E. Keevert, Jr., Rochester; Byron H. Rubin, Honeoye Falls, all of N.Y.

[73] Assignee: Eastman Kodak Company, Rochester, N.Y.

[21] Appl. No.: 173,300

[22] Filed: Dec. 22, 1993

[51] Int. Cl.[6] ..... G03C 1/015; G03C 1/005; G03C 1/04

[52] U.S. Cl. ..... 430/569; 430/567; 430/627; 430/628; 430/642

[58] Field of Search ..... 430/567, 569, 627, 628, 430/642

[56] References Cited

U.S. PATENT DOCUMENTS

| | | | |
|---|---|---|---|
| 3,511,818 | 5/1970 | Whiteley et al. . | |
| 3,536,677 | 10/1970 | Hollister . | |
| 3,615,624 | 10/1971 | Smith et al. . | |
| 3,692,753 | 9/1972 | Smith et al. . | |
| 3,749,577 | 7/1973 | Hollister et al. . | |
| 3,852,073 | 12/1974 | Fitzgerald | 430/627 |
| 4,400,463 | 8/1983 | Maskasky | 430/569 |
| 4,439,520 | 5/1984 | Kofron et al. | 430/569 |
| 4,713,320 | 12/1987 | Maskasky | 430/569 |
| 4,713,323 | 12/1987 | Maskasky | 430/569 |
| 4,914,014 | 4/1990 | Daubendiek et al. | 430/569 |
| 4,920,032 | 4/1990 | Toya et al. | 430/627 |
| 4,942,120 | 7/1990 | King et al. | 430/569 |
| 4,983,509 | 1/1991 | Inoue et al. | 430/627 |
| 5,057,409 | 10/1991 | Suga | 430/569 |
| 5,215,879 | 6/1993 | Suzuki et al. | 430/569 |

*Primary Examiner*—Charles L. Bowers, Jr.
*Assistant Examiner*—Mark F. Huff
*Attorney, Agent, or Firm*—Alfred P. Lorenzo

[57] ABSTRACT

A process for preparing a thin tabular grain silver halide emulsion comprised of silver halide grains which have a halide content of at least 50 mole percent bromide, wherein tabular grains of less than 0.15 micrometers in thickness and having an aspect ratio of greater than 8 account for greater than 50 percent of the total grain projected area, comprises the steps of nucleating the silver halide grains with a gelatino-peptizer or with the use of certain synthetic polymers that serve as effective nucleation peptizers and then growing the silver halide grains with the use of either a gelatino-peptizer or certain synthetic polymers that serve as effective growth peptizers.

15 Claims, No Drawings

PROCESS FOR PREPARING A THIN TABULAR GRAIN SILVER HALIDE EMULSION

CROSS-REFERENCE TO RELATED APPLICATIONS

Copending commonly-assigned U.S. patent application Ser. No. 171,588, filed Dec. 22, 1993 "Preparation of Thin Tabular Grain Silver Halide Emulsions Using Synthetic Polymeric Peptizers" by Wayne A. Bowman et al describes a process for preparing thin tabular grain silver halide emulsions, comprised of silver halide grains in which the halide content is at least 50 mole percent bromide and wherein tabular grains of less than 0.15 micrometers in thickness and having an aspect ratio of greater than 8 account for greater than 50 percent of the total grain projected area, utilizing synthetic polymeric peptizers characterized by the presence of both carboxyl functionality and tertiary amine or quaternary ammonium functionality.

FIELD OF THE INVENTION

This invention relates in general to photography and in particular to the preparation of silver halide emulsions that are useful in photography. More specifically, this invention relates to a novel process for preparing a thin tabular grain silver halide emulsion.

BACKGROUND OF THE INVENTION

The highest speed and therefore most commonly employed photographic elements are those which contain a radiation-sensitive silver bromide or bromoiodide emulsion layer coated on a support. Although other ingredients can be present, the essential components of the emulsion layer are radiation-sensitive silver bromide microcrystals, optionally containing iodide, commonly referred to as grains, which form the discrete phase of the photographic emulsion, and a vehicle, which forms the continuous phase of the photographic emulsion.

Interest in silver halide photography has recently focused on tabular grain emulsions, particularly thin intermediate and high aspect ratio tabular grain emulsions. It has been shown that these emulsions can produce a variety of photographic advantages, including increased sharpness, improved speed-granularity relationships, increased blue and minus-blue speed separations, more rapid developability, higher silver covering power when fully forehardened, reduced crossover in spectrally sensitized dual coated (also referred to as two sided or Duplitized ®) radiographic formats, and various imaging advantages in dye image transfer film units. *Research Disclosure*, Vol. 225, January 1983, Item 22534, is considered representative of these teachings, *Research Disclosure*is published by Kenneth Mason Publications, Ltd., Emsworth, Hampshire P010 7DD, England.

It is well known that silver halide emulsion preparation includes the stages of nucleation and growth. In the nucleation stage, new crystals of minute size are created. The growth stage involves addition of new material to existing crystals. These stages are distinct from the process of Ostwald ripening in which large crystals grow at the expense of small ones which are more soluble.

Both the nucleation and growth stages of silver halide emulsion preparation require the use of a peptizer to avoid the coalescence or flocculation of the silver halide grains. The vehicle encompasses both the peptizer and the binder employed in the preparation of a silver halide emulsion and the same material or different materials can be used to perform the functions of peptizer and binder.

While a variety of hydrophilic colloids are known to be useful peptizers, the most commonly employed peptizers are gelatin—e.g., alkali-treated gelatin (cattle bone or hide gelatin) or acid-treated gelatin (pigskin or cattle bone gelatin)—and gelatin derivatives—e.g., acetylated gelatin or phthalated gelatin. Gelatin and gelatin derivative peptizers are hereinafter collectively referred to as "gelatino-peptizers."

Materials useful as peptizers, particularly gelatin and gelatin derivatives, are also commonly employed as binders in preparing an emulsion for coating. However, many materials are useful as vehicle extenders, such as latices and other hydrophobic materials, which are inefficient peptizers.

The use of a gelatino-peptizer in preparing thin tabular grain silver bromide or bromoiodide emulsions is described in Maskasky, U.S. Pat. No. 4,713,320, issued December 15, 1987. While the gelatino-peptizers are very effective in preparing such tabular emulsions, they suffer from certain serious disadvantages. Thus, for example, gelatino-peptizers frequently contain impurities which hinder the ability to consistently prepare reproducible emulsions with consistent properties. Specifically, gelatin, which is a derivative of naturally occurring collagen, is very heterogeneous; containing a wide variety of molecules representing triple and double helices, single strands and fragments, as well as impurities such as nucleic acids, fats and non-gel proteins such as cystine and cysteine. Gelatino-peptizers may also lack sufficient resistance to bacterial decomposition and may not permit the use of as wide a range of dopants or chemical or spectral sensitizers as is desirable. In contrast with gelatino-peptizers, synthetic polymeric peptizers provide peptizer molecules that are uniform and can be optimized for specific desirable properties such as silver halide binding strength, solubility, metal ion complexing strength and ionic charge. A further advantage of synthetic polymeric peptizers is greater ease in transferring silver halide emulsions prepared in water to non-aqueous coating formats. After an emulsion has been prepared with the aid of one or more synthetic polymeric peptizers, gelatin can be added to serve as the binder so that the resulting emulsion can be handled in a conventional manner in a photographic system. Thus, synthetic polymeric peptizers have many advantages in the preparation of silver halide emulsions, including thin tabular grain silver halide emulsions. However, many synthetic polymers are very inefficient peptizers and the photographic art has long sought to develop synthetic polymers that would function in an effective manner as peptizers for silver halide grains.

One of the inefficiencies that has been encountered in the prior art in the preparation of tabular grain silver bromide and bromiodide emulsions is the presence of unwanted grain shapes. In addition to unwanted non-tabular grains, also in evidence are thick tabular grains, which have aspect ratios closely approaching those of non-tabular grains.

In addition to low aspect ratio tabular grains and non-tabular grains, these tabular grain emulsions also contain a significant population of grains which are in the form of rods. Because of their length and limited projected areas, rods are of marginal photographic utility. Beyond this, their presence in emulsions is disadvantageous in conventional procedures for manufacturing photographic elements containing silver halide emulsion layers.

It is also known that the introduction of iodide ions during the precipitation of tabular grain emulsions results in thickening of the tablular grains. Thus, when tabular grain silver bromide and silver bromoiodide emulsions precipitated under similar conditions and having similar mean grain diameters are compared, the tabular grain silver bromide emulsions exhibit higher average aspect ratios.

In light of the above, it is apparent that there is a critical need in the art for more effective synthetic polymeric peptizers in order to take advantage of the many benefits which synthetic polymers exhibit in comparison with gelatino-peptizers. There is particularly a critical need for synthetic polymeric peptizers capable of providing thin tabular grain emulsions of the bromide and bromoiodide type. The ability to replace gelatino-peptizers in at least one of the stages of nucleation and growth would represent a significant advance in the art of manufacturing thin tabular grain bromide and especially bromoiodide emulsions.

It is toward the objective of providing an improved process for preparing a thin tabular grain silver halide emulsion, which utilizes a synthetic polymeric peptizer and does not require the use of a gelatino-peptizer, that the present invention is directed.

SUMMARY OF THE INVENTION

The present invention provides a novel process for preparing a thin tabular grain silver halide emulsion comprised of silver halide grains which have a halide content of at least 50 mole percent bromide; wherein tabular grains of less than 0.15 micrometers in thickness and having an aspect ratio of greater than 8 account for greater than 50 percent of the total grain projected area. The process comprises the steps of nucleating the silver halide grains in the presence of a nucleation peptizer and thereafter growing the silver halide grains in the presence of a growth peptizer. The nucleation peptizer is a gelatino-peptizer or a synthetic polymer of Formula I as follows:

Formula I

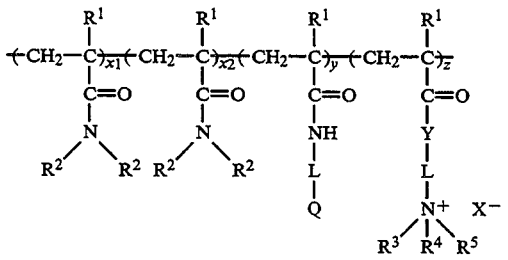

wherein:

$x_1$ is 0–84

$x_2$ is 0–84 y is 16–100 z is 0–10 each $R^1$ is, independently, hydrogen or a methyl group, each $R^2$ is, independently, hydrogen, a methyl group or an ethyl group, L is an alkylene or arylene group of 1 to 10 carbon atoms, Q is $CO_2^-M^+$ or $SO_3^-M^+$ wherein $M^+$ is hydrogen, an alkali metal or an $NH_4^+$, $NH_3R_1^+$, $NH_2R_1R_2^+$, $NHR_1R_2R_3^+$ or $NR_1R_2R_3R_4^+$ group wherein $R_1$, $R_2$, $R_3$ and $R_4$ are independently alkyl groups of 1 to 6 carbon atoms, Y is —O— or

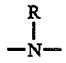

wherein R is hydrogen, a methyl group or an ethyl group, $R^3$, $R^4$ and $R^5$ are independently hydrogen or an alkyl group of 1 to 6 carbon atoms or $R^3$, $R^4$ and $R^5$ taken together with the nitrogen atom to which they are attached form a five- or six-membered ring which can include an oxygen heteroatom, $X^-$ is $Cl^-$, $Br^-$, $I^-$, $R^6CO_2^-$, $R^6OSO_3^-$, $R^6SO_3^-$ or $R^6SO_2^-$ wherein $R^6$ is an alkyl or aryl radical of 1 to 10 carbon atoms.

The growth peptizer is a gelatino-peptizer or a synthetic polymer of Formula I wherein $x_1+x_2$ is 50–83, y is 15–40 and z is 1–10, with the proviso that at least one of the nucleation peptizer and the growth peptizer is a synthetic polymer of Formula I.

Use of nucleation peptizers and growth peptizers in accordance with the above definitions has been unexpectedly found to provide emulsions in which the major morphology is tabular, which have the desired grain thickness of less than 0.15 micrometers and which have the desired high aspect ratio of greater than 8. Thus, the invention permits the emulsion formulator to take advantage of the benefits of synthetic polymers and to avoid the use of gelatino-peptizers entirely. If desired, a gelatino-peptizer can be used as nucleation peptizer in combination with a synthetic polymer as growth peptizer. Alternatively, a synthetic polymer can be used as nucleation peptizer in combination with a gelatino-peptizer as growth peptizer. In a particularly preferred embodiment of the invention, the aforesaid tabular grains have a thickness of less than 0.10 micrometers.

DETAILED DESCRIPTION OF THE INVENTION

As applied to silver halide grains, the term "thin" as used herein refers to a grain thickness of less than 0.15 micrometers as measured on an electron micrograph.

"Aspect ratio" is defined as the ratio of the equivalent circular diameter to the grain thickness. A high aspect ratio is one which is greater than 8.

"Equivalent circular diameter" refers to the diameter of a circle having the same projected area as the projected area of the silver halide grain.

As used herein, the term "3D" refers to non-tabular morphologies, for example cubes, octahedra, rods and spherical grains, and to tabular grains having an aspect ratio of less than 5.

In precipating thin tabular grain silver bromide and bromoiodide emulsions, it is recognized in the art that the bromide ion concentration in solution at the stage of grain formation must be maintained within relatively narrow limits to achieve the desired tabularity of the grains. As grain growth continues, the bromide ion concentration in solution becomes progressively less influential on the grain shape ultimately achieved. For example, Wilgus et al U.S. Pat. No. 4,434,226 teaches the precipitation of high aspect ratio tabular grain silver bromoiodide emulsions at bromide ion concentrations in the pBr range of from 0.6, preferably 1.1, to 1.6 during grain nucleation with the pBr range being expanded to 0.6 to 2.2 during subsequent grain growth. Kofron et al U.S. Pat. No. 4,439,520 extends these teachings to the precipitation of high aspect ratio tabular grain silver bromide emulsions. Since silver iodide exhibits a solubility product constant approximately three orders of magnitude lower than that of silver bromide, the low incidence of iodide ions in solution during precipitation does not significantly alter useful pBr ranges. (pBr is defined as the negative log of the solution bromide ion concentration.)

As indicated hereinabove, the nucleation peptizer utilized in this invention is a gelatino-peptizer or a synthetic polymer of Formula I above. As indicated by Formula I, the nucleation peptizer can be a homopolymer formed from a single monomer or a copolymer formed from two different monomers or an interpolymer formed from three or more different monomers. The synthetic polymeric peptizers of Formula I are characterized by the presence of amido functionality. A gelatino-peptizer, for example, oxidized gelatin (referred to hereinafter as OX-GEL) can be used as the growth peptizer. Alternatively, the growth peptizer can be a synthetic polymer of Formula I in which $x_1+x_2$ is 50–83, y is 15–40 and z is 1–10. It will be noted that the scope of synthetic polymers useful as nucleation peptizers is much greater than the scope of synthetic polymers useful as growth peptizers.

The synthetic polymers utilized herein can be prepared by standard methods known in the art, using batch or semicontinuous modes of addition at 60 to 70° C., initiation by azoisobutyronitrile (AIBN) or by other known free radical initiators, and a solvent system consisting of water, water/ethanol, water/methanol, or methanol.

Particularly good results are achieved in this invention when the nucleation peptizer is a polymer of Formula II as follows:

Formula II

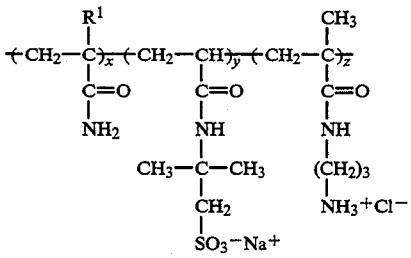

wherein x is 0–84, y is 16–100, z is 0–10 and $R^1$ is hydrogen or a methyl group; and the growth peptizer is a gelatino-peptizer or a polymer of Formula II in which x is 50–83, y is 15–40, z is 2–10 and $R^1$ is hydrogen or a methyl group.

As shown by the working examples provided herein, use of nucleation peptizers and growth peptizers outside of the scope of the definitions set forth herein does not provide the desired product wherein tabular grains of less than 0.15 micrometers in thickness and having an aspect ratio of greater than 8 account for greater than 50 percent of the total grain projected area.

In carrying out the present invention, silver, bromide, and, optionally, iodide ions are concurrently run into the reaction vessel. The silver ions are preferably supplied in an aqueous solution of silver nitrate. The bromide and iodide ions are preferably supplied, separately or together, in aqueous solutions of ammonium or alkali metal salts. Mignot U.S. Pat. No. 4,334,012, which is concerned with ultrafiltration during emulsion precipitation and here incorporated by reference, sets forth a variety of preferred procedures for managing the introduction of peptizer, silver, bromide, and iodide ions during emulsion precipitation. Introduction of silver and halide ions in the form of a Lippmann emulsion, as taught by Mignot, is specifically contemplated.

Modifying compounds can be present during emulsion precipitation. Such compounds can be initially in the reaction vessel or can be added along with one or more of the peptizers and ions identified above. Modifying compounds, such as compounds of copper, thallium, lead, bismuth, cadmium, zinc, middle chalcogens (i.e., sulfur, selenium, and tellurium), gold, and Group VIII noble metals can be present during precipitation, as illustrated by Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,950,972; Sidebotham U.S. Pat. No. 3,488,709; Rosecrants et al U.S. Pat. No. 3,737,313; Berry et al U.S. Pat. No. 3,772,031; Atwell U.S. Pat. No. 4,269,927; and *Research Disclosure*, Vol. 134, June, 1975, Item 13452. It is also possible to introduce one or more spectral sensitizing dyes into the reaction vessel during precipitation, as illustrated by Locker et al U.S. Pat. No. 4,225,666.

The emulsions produced by the process of this invention are thin tabular grain emulsions comprised of silver bromide or bromoiodide grains having a thickness of less than 0.15 micrometers and an aspect ratio of greater than 8. Such grains account for greater than 50 percent of the total grain projected area of the emulsion, more preferably greater than 70 percent and most preferably greater than 90 percent. The silver halide grains preferably have an average grain diameter of at least about 0.5 micrometers and more preferably of at least about one micrometer.

The thin tabular grain emulsions produced by the process of this invention can be put to photographic use as precipitated, but are in most instances adapted to serve specific photographic applications by procedures well known in the art. It is important to note that once an emulsion has been prepared as described above any conventional vehicle, including gelatin and gelatin derivatives, can be introduced while still realizing all of the advantages of the invention described above. Also the emulsions can be blended with other silver halide emulsions, as illustrated by *Research Disclosure*, Item 17643, Section I, Paragraph F, and Dickerson U.S. Pat. No. 4,520,098. Other useful vehicle materials are illustrated by *Research Disclosure*, Item 17643, Section IX. Conventional hardeners can be used, as illustrated by Item 17643, Section X. The emulsions can be washed following precipitation, as illustrated by Item 17643, Section II. The emulsions can be chemically and spectrally sensitized as described by Item 17643, Sections III and IV; however, the emulsions are preferably chemically and spectrally sensitized as taught by Kofron et al U.S. Pat. No. 4,439,520, cited above. The emulsions can contain antifoggants and stabilizers, as illustrated by Item 17643, Section VI.

In yet another aspect, the present invention is directed to a photographic element comprised of a support and at least one radiation-sensitive emulsion layer comprised of a thin tabular grain silver halide emulsion prepared by the process according to this invention, and optionally other silver halide emulsions or other layers.

Peptizers utilized in the examples or comparative examples which follow include polyvinyl alcohol (peptizer P-1) which is comprised of repeating units of the formula:

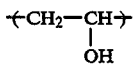

peptizers P-2 to P-15 which are represented by the formula:

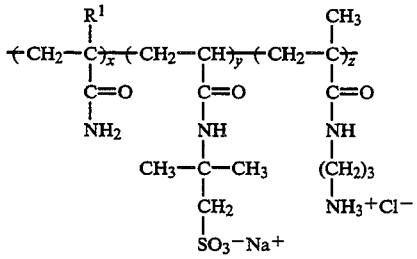

wherein x, y, z and $R^1$ are as indicated in the following table.

| Peptizer | x | y | Z | $R^1$ |
|---|---|---|---|---|
| P-2 | 100 | 0 | 0 | H |
| P-3 | 80 | 15 | 5 | H |
| P-4 | 60 | 35 | 5 | H |
| P-5 | 80 | 19 | 1 | H |
| P-6 | 42 | 49 | 9 | H |
| P-7 | 65 | 32.5 | 2.5 | H |
| P-8 | 67 | 23 | 10 | H |
| P-9 | 95 | 5 | 0 | H |
| P-10 | 80 | 20 | 0 | H |
| P-11 | 20 | 80 | 0 | H |
| P-12 | 50 | 50 | 0 | H |
| P-13 | 0 | 87 | 13 | H |
| P-14 | 0 | 100 | 0 | H |
| P-15 | 60 | 35 | 5 | $CH_3$ |

Peptizer P-16 which has the formula:

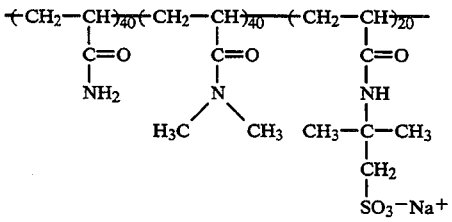

Peptizer P-17 which has the formula:

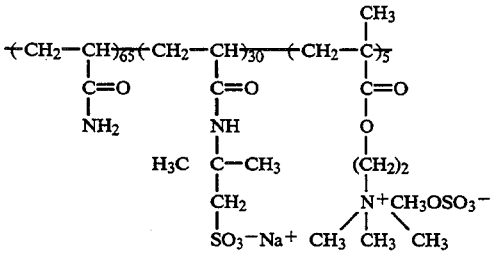

Peptizer P-18 which has the formula:

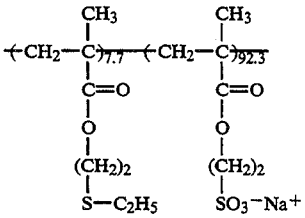

An illustrative preparation for the synthetic polymeric peptizers is the preparation of peptizer P-3 which was carried out as follows:

Acrylamide (568 g, 8.0 moles, mw=71), 2-sulfo-1,1-dimethylethylacrylamide sodium salt (345 g, 1.5 moles, mw=230, 595 g of 58% solution) and N-(3-aminopropyl)-methacrylamide hydrochloride (89 g, .5 moles, mw=178) were combined in ethanol/water (1.5:6.0 liter). The mixture was purged with nitrogen for 15 minutes at 60° C. AIBN (16 g) in acetone (200 ml) was added in one portion (1:30 pm). The solution was stirred 18 hours and diafiltered (20K cutoff, 20 liters effluent).

wt. 8028 g, 9.6% solids iv 1.06 dl/g 0.25% in 0.1M $Na_2SO_4$ Theory: C, 45.56, H, 6.59, N, 14.68 Found: C, 47.26, H, 6.97, N, 15.43

A second illustrative preparation for the synthetic polymeric peptizers is the preparation of peptizer P-10 which was carried out as follows:

Acrylamide (114 g, 1.6 moles, mw=71) and 2-sulfo-1,1-dimethylethylacrylamide sodium salt (91.6 g, 0.4 moles, mw=229, 158 g of 58% solution) were combined in methanol (500 ml). The mixture was purged with nitrogen for 15 minutes at 20° C. and 60° C. AIBN (3.2 g) in acetone (100 ml) was added in one portion. The solution remained clear during the 18-hour reaction time. The product was diafiltered (20K cutoff).

wt 2257 g, 7.8% solids iv 1.25 dl/g (0.25% in 0.1M $Na_2SO_4$) Theory: C, 44.44, H, 6.28, N, 13.64 Found: C, 43.63, H. 6.41, N, 13.38

Preferred polymers for use as nucleation peptizers in this invention are polymers of Formula II wherein x is 20–80, y is 20–80 and z is 0–5.

Preferred polymers for use as growth peptizers in this invention are polymers of Formula II wherein x is 60–75, y is 20–35 and z is 2–8.

A particularly preferred polymer for use as a nucleation peptizer in this invention is polymer P-12 which is comprised of repeating units of the formula:

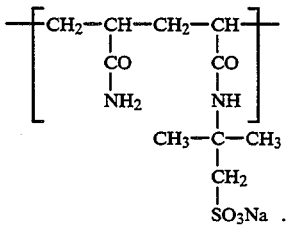

The invention is further illustrated by the following examples of its practice. The average aspect ratio reported in the working examples herein is the ratio of the average equivalent circular diameter to the average thickness of the tabular grains in the emulsion.

Examples 1–3

A control test, referred to as Control 1, using a gelatino-peptizer as both the nucleation peptizer and the growth peptizer was carried out in the following manner:

Fully-oxidized alkali-processed ossein gelatin was added to an emulsion kettle to give a nucleation peptizer concentration of 0.15 wt %, along with 1.0 g NaBr per liter of deionized water. The kettle was maintained at 70° C. while 2.0 N $AgNO_3$ was pumped in for 1.5 minutes along with sufficient halide salt solution to maintain a constant bromide concentration. The salt solution consisted of 2.0 moles per liter NaBr. This constitutes the "nucleation" step, which establishes the initial grain population. The steps following this are considered "growth" steps. Additional salt solution was then supplied to establish a concentration of 4.0 g NaBr per liter. Oxidized gel was also added (growth peptizer) to bring the gel concentration to 0.8 wt %. Additional $AgNO_3$ was then pumped in following an accelerated profile, along with sufficient NaBr to maintain a concentration of 4.0 g NaBr per liter. The silver nitrate flow rate was started below the rate used during nucleation but was increased over a 40 minute period to more than 10 times the nucleation flow rate. The resulting emulsion was examined in a scanning electron microscope. The grains were 95% tabular, having an average thickness of 0.04 micrometers and an average aspect ratio of 53.

Example 1 was carried out in the same manner as Control Test 1, except that polymer P-10 was used as the nucleation peptizer and polymer P-3 was used as the growth peptizer. Examples 2 and 3 both used oxidized gelatin as the growth peptizer and used polymer P-10 and polymer P-16, respectively, as the nucleation peptizer. Examples 1 to 3 produced emulsions that were 70 to 80% tabular and had grains with an average thickness of 0.04 to 0.08 micrometers and an average aspect ratio of 19 to 53.

Comparative Examples A to I utilized combinations of nucleation peptizer and growth peptizer outside the definitions provided herein. They produced emulsions in which the major morphology was 3D, or in Comparative Example G, a coagulate or in Comparative Example H, a coagulate which included tabular grains. Comparing Comparative Example I with Comparative Example H, it is seen that doubling the concentration of growth peptizer resulted in predominantly 3D structures.

The results obtained in the control test, in Examples 1 to 3 and in Comparative Examples A to I are summarized for convenience in Table I below.

TABLE I

| Example Number | Nucleation Peptizer | Growth Peptizer | Major Morphology | % Major Morphology | Average Diameter (micrometers) | Average Thickness (micrometers) | Average Aspect Ratio |
|---|---|---|---|---|---|---|---|
| Control 1 | OX-GEL | OX-GEL | Tabular | 95 | 2.1 | 0.04 | 53 |
| Example 1 | P-10 | P-3 | Tabular | 70 | 1.4 | 0.08 | 19 |
| Example 2 | P-10 | OX-GEL | Tabular | 80 | 2.1 | 0.04 | 53 |
| Example 3 | P-16 | OX-GEL | Tabular | 80 | 1.7 | 0.06 | 29 |
| Comp. A | P-2 | OX-GEL | 3D | 60 | — | — | — |
| Comp. B | P-1 | OX-GEL | 3D | 50 | — | — | — |
| Comp. C | P-3 | OX-GEL | 3D | 60 | — | — | — |
| Comp. D | P-3 | P-3 | 3D | 60 | — | — | — |
| Comp. E | P-9 | OX-GEL | 3D | 60 | — | — | — |
| Comp. F | P-10 | P-1* | 3D | 90 | — | — | — |
| Comp. G | P-10 | P-10 | Coagulate | — | — | — | — |
| Comp. H | P-10 | P-2 | Coagulate | — | — | — | — |
| Comp. I* | P-10 | P-2 | 3D | 50 | — | — | — |

*In this test, the concentration of growth peptizer P-2 was 1.6%.
**Molecular weight was approximately 93000.

Examples 4–13

A control test, referred to as Control 2, using a gelatino-peptizer as both the nucleation peptizer and the growth peptizer was carried out in the following manner:

In this procedure, oxidized gelatin was used at a concentration of 0.10 wt % in nucleation, along with 1.0 g NaBr per liter of deionized water. The kettle was maintained at 50° C. 2.0 N $AgNO_3$ was pumped in for 1.5 minutes along with sufficient halide salt solution to maintain a constant bromide concentration. The salt solution consisted of 1.99 moles per liter NaBr plus 0.01 moles per liter KI. This constitutes the "nucleation" step. The steps following this are considered "growth" steps. Additional salt solution was supplied to establish a concentration of 2.5 g NaBr per liter. The temperature was next increased at 1.7° C. per minute up to 60° C. Oxidized gel was added to bring the gel concentration to 0.8 wt %. Additional $AgNO_3$ was pumped in following an accelerated profile, along with sufficient NaBr to maintain a concentration of 2.06 g NaBr/l. The silver nitrate flow rate was started below the rate used during nucleation and it was increased over 40 minutes to a rate more than 10 times the nucleation flow rate. Finally, the silver nitrate flow was continued alone at an intermediate rate until the equivalent NaBr content of the kettle was 0.5 g/l. The resulting emulsion was examined in a scanning electron microscope. The grains were 95% tabular and had an average thickness of 0.05 micrometers and an average aspect ratio of 22.

Examples 4–13 were carried out in the same manner as Control test 2 except that peptizers selected in accordance with the definitions herein were utilized, as indicated in Table II. Examples 4–13 produced emulsions that were 80 to 95% tabular, had grains with an average thickness of 0.05 to 0.07 micrometers and average aspect ratios of 13 to 26.

Comparative Examples J, K, L and M, reported in Table II, utilized combinations of nucleation peptizer and growth peptizer outside the definitions provided herein. They produced either thick tabular grains (0.20 micrometers) or non-tabular (3D) morphologies.

TABLE II

| Example Number | Nucleation Peptizer | Growth Peptizer | Major Morphology | % Major Morphology | Average Diameter (micrometers) | Average Thickness (micrometers) | Average Aspect Ratio |
|---|---|---|---|---|---|---|---|
| Control 2 | OX-GEL | OX-GEL | Tabular | 95 | 1.1 | 0.05 | 22 |
| Example 4 | P-11 | OX-GEL | Tabular | 85 | 1.1 | 0.05 | 22 |
| Example 5 | P-11 | P-4 | Tabular | 95 | 1.1 | 0.05 | 22 |
| Example 6 | P-12 | P-4 | Tabular | 90 | 1.2 | 0.05 | 24 |
| Example 7 | P-12 | P-7 | Tabular | 90 | 1.3 | 0.05 | 26 |
| Example 8 | P-12 | P-15 | Tabular | 95 | 1.2 | 0.05 | 24 |
| Example 9 | P-12 | P-8 | Tabular | 80 | 1.4 | 0.07 | 20 |
| Example 10 | P-14 | P-4 | Tabular | 90 | 1.0 | o:ob | 17 |
| Example 11 | P-17 | P-17 | Tabular | 85 | 1.0 | 0.06 | 17 |
| Example 12 | OX-GEL | P-3 | Tabular | 80 | 0.94 | 0.07 | 13 |
| Example 13 | OX-GEL | P-4 | Tabular | 95 | 1.2 | 0.05 | 24 |
| Comp. J | P-11 | P-14 | 3D | 100 | — | — | — |
| Comp. K | P-12 | P-6 | 3D | 80 | — | — | — |
| Comp. L | P-11 | P-13 | Tabular | 60 | 0.70 | 0.20 | 4 |
| Comp. M | P-18 | P-18 | 3D | 70 | — | — | — |

Examples 14–19

A control test, referred to as Control 3, using a gelatino-peptizer as both the nucleation peptizer and the growth peptizer was carried out in the same manner as Control Test 2 except that the salt solution contained 2.0 moles NaBr per liter and no iodide and the last "$AgNO_3$-only" flow segment was omitted. The resulting emulsion was 95% tabular and had an average thickness of 0.04 micrometers and an average aspect ratio of 28.

Examples 14–19 were carried out in the same manner as Control Test 3 except that peptizers selected in accordance with the definitions herein were utilized, as indicated in Table III. Examples 14–19 produced emulsions that were 70 to 93% tabular, had grains with an average thickness of 0.04 to 0.12 micrometers and average aspect ratios of 11 to 48.

TABLE III

| Example Number | Nucleation Peptizer | Growth Peptizer | Major Morphology | % Major Morphology | Average Diameter (micrometers) | Average Thickness (micrometers) | Average Aspect Ratio |
|---|---|---|---|---|---|---|---|
| Control 3 | OX-GEL | OX-GEL | Tabular | 95 | 1.1 | 0.04 | 28 |
| Example 14 | P-4 | OX-GEL | Tabular | 93 | 1.5 | 0.04 | 38 |
| Example 15 | P-12 | OX-GEL | Tabular | 85 | 1.9 | 0.04 | 48 |
| Example 16 | P-11 | P-4 | Tabular | 90 | 1.8 | 0.05 | 36 |
| Example 17 | P-12 | P-4 | Tabular | 9 0 | 1.6 | 0.08 | 45 |
| Example 18 | P-10 | P-3 | Tabular | 8 5 | 1.6 | 0.08 | 20 |
| Example 19 | P-10 | P-5 | Tabular | 70 | 1.3 | 0.12 | 11 |

Considering all of the data reported in Tables I, II and III, it is apparent that selecting a nucleation peptizer and a growth peptizer in accordance with the criteria set forth herein provides comparable performance to using a gelatino-peptizer as both the nucleation peptizer and the growth peptizer. However, use of synthetic polymeric peptizers in accordance with the criteria of this invention as nucleation peptizer, as growth peptizer or as both nucleation and growth peptizer, also provides the important benefits achievable with the use of synthetic polymeric peptizers as described hereinabove.

The invention has been described in detail, with particular reference to certain preferred embodiments thereof, but it should be understood that variations and modifications can be effected within the spirit and scope of the invention.

We claim:

1. A process for preparing a thin tabular grain silver halide emulsion comprised of silver halide grains in which the halide content is at least 50 mole percent bromide and wherein tabular grains of less than 0.15 micrometers in thickness and having an aspect ratio of greater than 8 account for greater than 50 percent of the total grain projected area; said process comprising the steps of nucleating said silver halide grains in the presence of a nucleation peptizer and thereafter growing said silver halide grains in the presence of a growth peptizer, wherein said nucleation peptizer is a gelatino-peptizer or a synthetic polymer of the following Formula I:

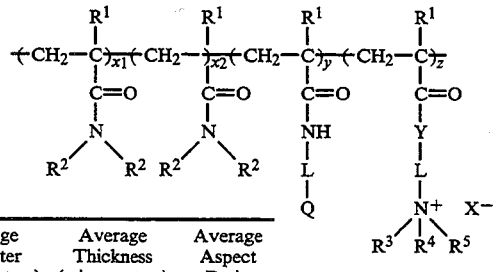

wherein:

$x_1$ is 0–84

$x_2$ is 0–84 y is 16–100 z is 0–10 each $R^1$ is, independently, hydrogen or a methyl group, each $R^2$ is, independently, hydrogen, a methyl group or an ethyl group, L is an alkylene or arylene group of 1 to 10 carbon atoms, Q is $CO_2^-M^+$ or $SO_3^-M^+$ wherein $M^+$ is hydrogen, an alkali metal or an $NH_4^+$, $NH_3R_1^+$, $NH_2R_1R_2^+$, $NHR_1R_2R_3^+$ or $NR_1R_2R_3R_4^+$ group wherein $R_1$, $R_2$, $R_3$ and $R_4$ are independently alkyl groups of 1 to 6 carbon atoms, Y is —O— or

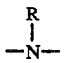

wherein R is hydrogen, a methyl group or an ethyl group, $R^3$, $R^4$ and $R^5$ are independently hydrogen or an alkyl group of 1 to 6 carbon atoms or $R^3$, $R^4$ and $R^5$ taken together with the nitrogen atom to which they are attached form a five- or six-membered ring which can include an oxygen heteroatom, $X^-$ is $Cl^-$, $Br^-$, $I^-$, $R^6CO_2^-$, $R^6OSO^3-$, $R^6SO_3^-$ or $R^6SO_2^-$ where $R^6$ is an alkyl or aryl radical of 1 to 10 carbon atoms, and said growth peptizer is a gelatino-peptizer or a synthetic polymer of Formula I wherein $x_1+x_2$ is 50–83, y is 15–40 and z is 1–10, with the proviso that at least one of said nucleation peptizer and said growth peptizer is a synthetic polymer of Formula I.

2. A process as claimed in claim 1, wherein said tabular grains account for greater than 70 percent of the total grain projected area.

3. A process as claimed in claim 1, wherein said tabular grains account for greater than 90 percent of the total grain projected area.

4. A process as claimed in claim 1, wherein said nucleation peptizer is a polymer of Formula I in which each $R^1$ is a methyl group.

5. A process as claimed in claim 1, wherein said nucleation peptizer is a polymer comprised of repeating units of the formula:

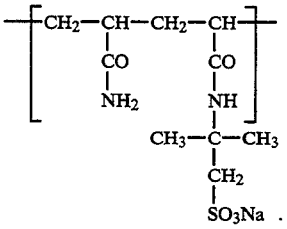

6. A process as claimed in claim 1, wherein said growth peptizer is a gelatino-peptizer.

7. A process as claimed in claim 1, wherein said nucleation peptizer is a polymer of the following Formula II:

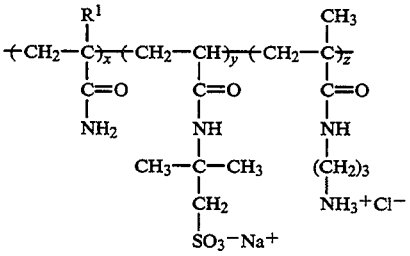

wherein x is 0–84, y is 16–100, z is 0–10 and $R^1$ is hydrogen or a methyl group; and said growth peptizer is a gelatino peptizer or a polymer of Formula II wherein x is 50–83, y is 15–40, z is 2–10 and $R^1$ is hydrogen or a methyl group.

8. A process as claimed in claim 1, wherein said growth peptizer is oxidized gelatin.

9. A process as claimed in claim 1, wherein said nucleation peptizer is a polymer of the formula:

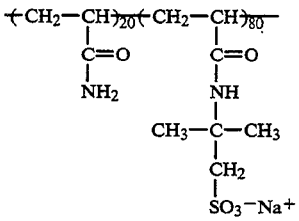

and said growth peptizer is a polymer of the formula:

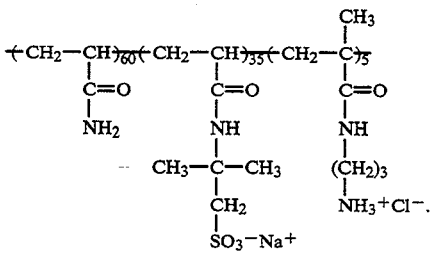

10. A process as claimed in claim 1, wherein said nucleation peptizer is a polymer of the formula:

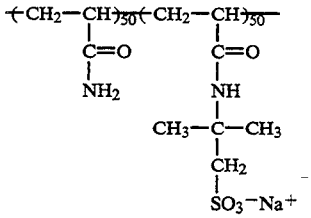

and said growth peptizer is a polymer of the formula:

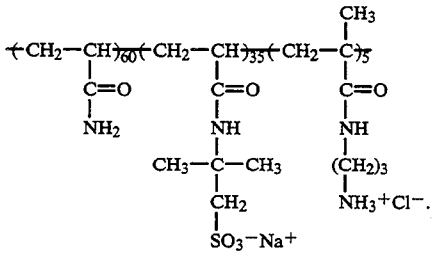

11. A process as claimed in claim 7, in which said nucleation peptizer is a polymer of Formula II wherein x is 20–80, y is 20–80 and z is 0–5 and said growth peptizer is a polymer of Formula II wherein x is 60–75, y is 20–35 and z is 2–8.

12. A process as claimed in claim 1, wherein said nucleation peptizer is a gelatino-peptizer.

13. A thin tabular grain silver halide emulsion prepared by the process of claim 1.

14. A thin tabular grain silver halide emulsion prepared by the process of claim 7.

15. A thin tabular grain silver halide emulsion prepared by the process of claim 11.

* * * * *